US006554699B1

(12) United States Patent
Johansson

(10) Patent No.: US 6,554,699 B1
(45) Date of Patent: Apr. 29, 2003

(54) SCREENING ARRANGEMENT IN A VENTILATION SYSTEM

(75) Inventor: Lennart Johansson, Mariestad (SE)

(73) Assignee: Nivell System AB, Mariestad (SE)

( * ) Notice: Subject to any disclaimer, the term of this patent is extended or adjusted under 35 U.S.C. 154(b) by 0 days.

(21) Appl. No.: 10/018,490

(22) PCT Filed: May 31, 2000

(86) PCT No.: PCT/SE00/01123

§ 371 (c)(1),
(2), (4) Date: Jan. 28, 2002

(87) PCT Pub. No.: WO00/79066

PCT Pub. Date: Dec. 28, 2000

(30) Foreign Application Priority Data

Jun. 21, 1999 (SE) ..... 9902352

(51) Int. Cl.[7] ..... F24F 7/00
(52) U.S. Cl. ..... 454/185; 454/169; 165/168
(58) Field of Search ..... 454/185, 169, 454/170, 172; 165/168, 169

(56) References Cited

U.S. PATENT DOCUMENTS 3,747,503 A * 7/1973 Lovell ..... 454/170
3,863,554 A * 2/1975 Boyd ..... 454/170
4,111,186 A * 9/1978 Ross et al. ..... 126/626
4,398,451 A * 8/1983 Werthmann ..... 454/170
4,677,903 A * 7/1987 Mathews, III ..... 454/185
5,308,280 A * 5/1994 Dotson ..... 454/170
5,353,867 A * 10/1994 Jaspers ..... 165/165
5,934,990 A * 8/1999 Steffenino et al. ..... 454/170
6,079,481 A * 6/2000 Lowenstein et al. ..... 165/10

FOREIGN PATENT DOCUMENTS

WO 98/48122 10/1998

* cited by examiner

*Primary Examiner*—Derek Boles
(74) *Attorney, Agent, or Firm*—Nixon & Vanderhye P.C.

(57) ABSTRACT

An arrangement for screening off a ventilated space (5) in a floor construction arranged on a subfloor (2) and having joists (6) that are supported by a plurality of level-adjusting spacer screws (8) resting on the subfloor (2) to create a free passage (9) between the joist and the subfloor as well as said space, which includes said passages, between the subfloor and the floor construction. In accordance with the invention, the arrangement comprises an elongate plate-shaped body (116) with a flat waist part(117), a foot part (118) and a top part (119), which foot and top parts extend along the long sides of the waist part and are flexibly connected to the waist part by means of joints (122, 123) that are parallel to each other. The plate body is arranged to be anchored with its top part to a vertical side of one of said joists by means of attachment elements (12) anchored with its foot part to the subfloor by means of attachment elements (121).

13 Claims, 4 Drawing Sheets

SCREENING ARRANGEMENT IN A VENTILATION SYSTEM

This application is the U.S. national phase of international application PCT/SE00/01 123 filed May 31, 2000, which designated the U.S.

The present invention refers to an arrangement for screening off a ventilated space in a floor construction in a building, which space forms part of a ventilation system, which floor construction is arranged on a subfloor and comprises a plurality of joists arranged at a pre-determined distance from each other and supported by a plurality of level-adjusting spacer screws resting on the subfloor to create a free passage between the joist and the subfloor as well as said space, which includes said passages between the subfloor and the floor construction.

The ventilation of subfloors, i.e. the rigid foundation supporting floor constructions, requires the ventilating air to be distributed evenly across the entire surface of the subfloor. Air-flows take place towards a created partial vacuum in the exhaust air, the supply air being taken from the room or premises above the floor construction. The air is extracted from the subfloor by way of pipes connected to an exhaust-air fan, which pipes are provided with holes according to a system to obtain uniform evacuation of the ventilation air along the entire length of the pipe.

In the case of a ventilated floor construction of the kind described above it is frequently necessary to partition the ventilated space into sections and to seal the same from its surroundings in particular locations. When the space is so large that the fan device contains several fans, the space is sectioned to render the ventilation of the space as uniform as possible. The sectioning is also performed to partition a first section of the space in a finished part of the floor construction from a second section of the space in an unfinished part of the floor construction or from a second part that will not form part of the ventilation system. The ventilated space can also be partitioned from another construction part in the building to seal the ventilated space from its surroundings by this construction part.

A foamed-plastic material has hitherto been used to achieve such sectioning and sealing partitioning. Such jointing foam is not suitable from the point of view of environmental protection, however, and must be applied with special equipment.

The object of the present invention is to eliminate the problems discussed above and to provide a screening arrangement that can be mounted quickly and simply whilst erecting a floor construction to form an effective, tight partitioning between two sections of the ventilated space or against a particular construction part in the building located within or adjacent to the floor construction.

The screening arrangement in accordance with the invention is characterized in that it comprises an elongate plate-shaped body that is impermeable to air and includes a flat waist part, a foot part and a top part, which foot and top parts extend along the long sides of the waist part and are flexibly connected to the waist part by means of joints that are parallel to each other, which plate body is arranged to be anchored with its top part to a vertical side of one of said joists by means of attachment elements and arranged to be anchored with its foot part to the subfloor by means of attachment elements, the waist part being arranged to form a right or acute angle with the subfloor so as to form an airtight screen between two sections of the ventilated space or between the ventilated space and a non-ventilated space in the floor construction.

The invention will be further described in the following with reference to the drawings.

Figure 1:
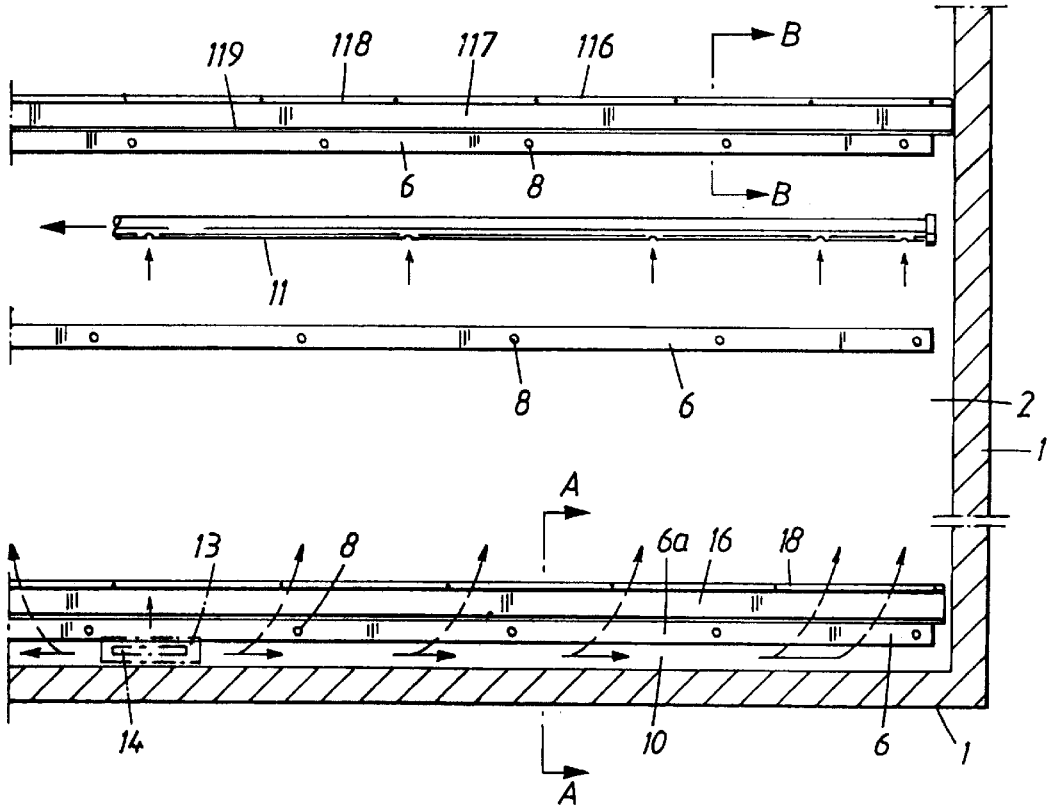
FIG. 1 shows schematically parts of a floor construction and ventilation system in a building, viewed from above.
Figure 2:
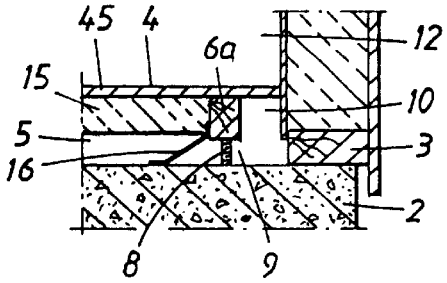
FIG. 2 is a cross section along the line A—A in FIG. 1.
Figure 3:
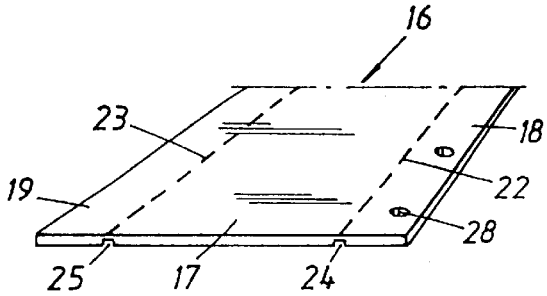
FIG. 3 is a perspective view of a plate body in an air-distribution device used in the floor construction in accordance with FIG. 1.
Figure 4:
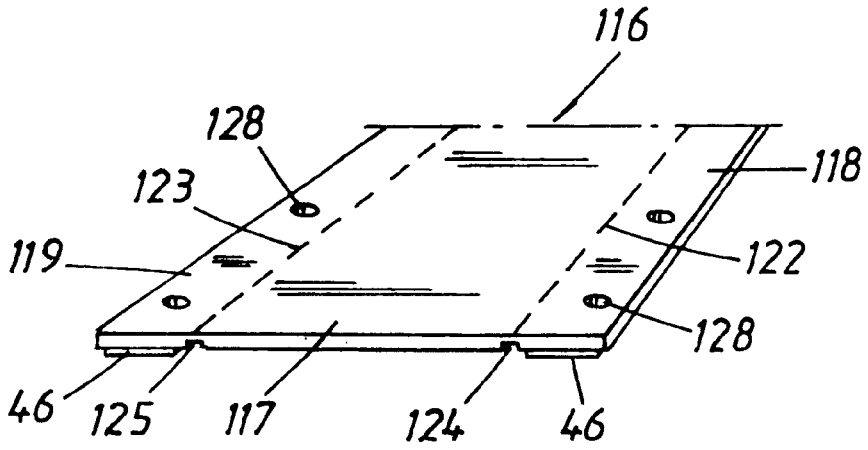
FIG. 4 is a perspective view of a plate body in a screening arrangement used in the floor construction in accordance with FIG. 1.
Figure 10:
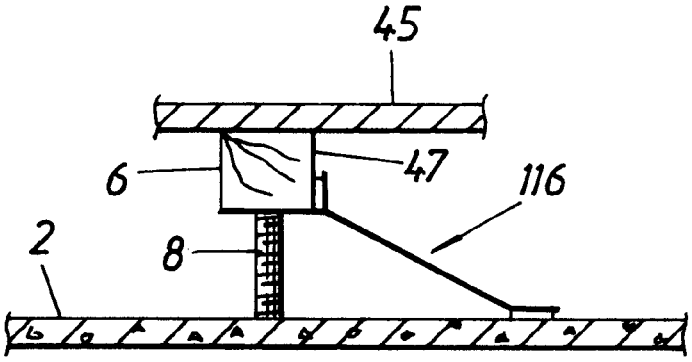
FIG. 10 is a cross section taken along the line B—B in FIG. 1.
Figure 5:
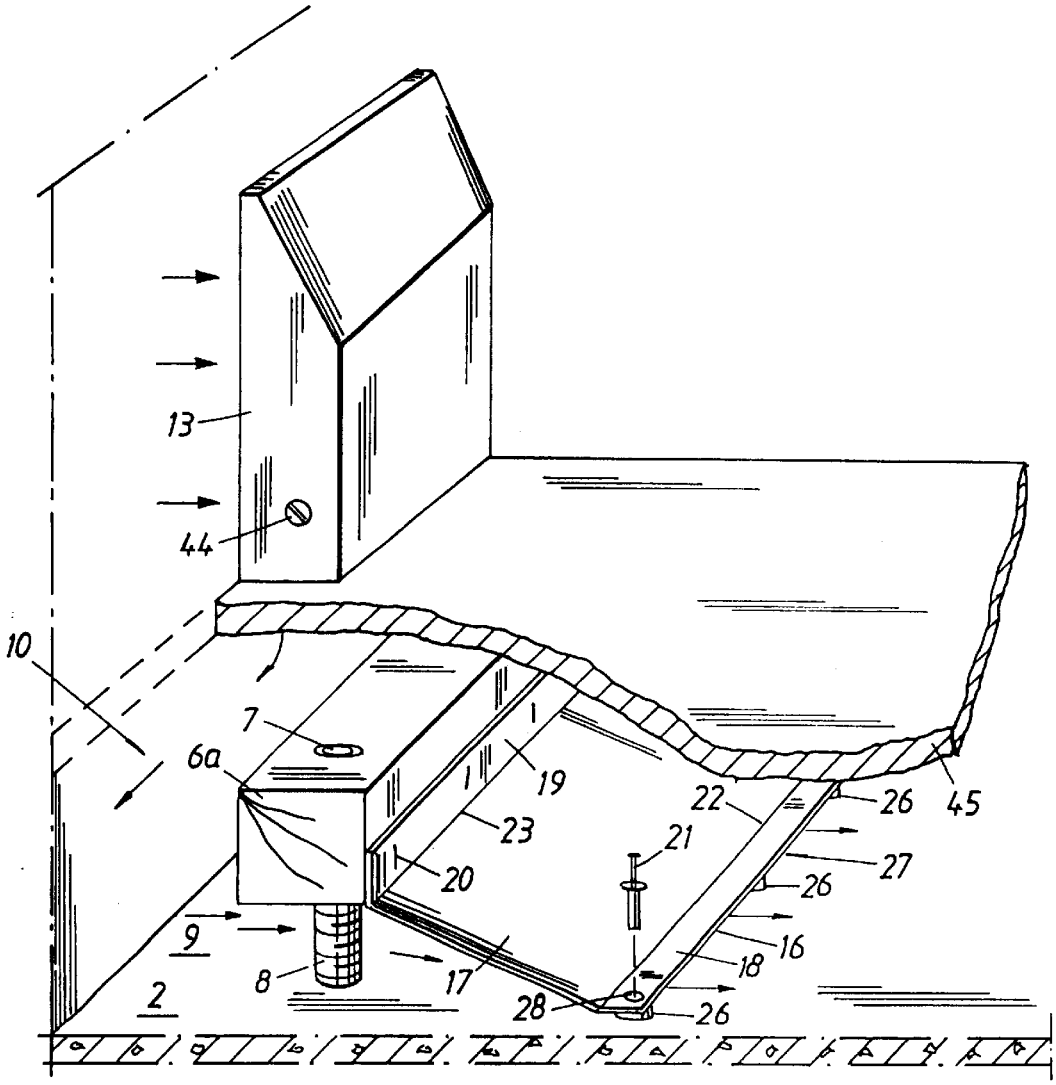
FIG. 5 is a perspective view of a part of the building and the floor construction, partly sliced through, in accordance with FIG. 1 and shows an air-inlet device for the supply air and the plate body in accordance with FIG. 3.

FIGS. 1–6 show schematically parts of a floor construction in a building with walls 1 and a rigid supporting foundation or subfloor 2, usually of concrete, which can have a surface with a texture ranging from smooth to relatively uneven and rough. The walls 1 are outer walls, each comprising a base beam or ground sill 3. The floor construction comprises a flooring 4, which together with the foundation 2 defines a space 5, and a plurality of joists 6 that carry the flooring 4. The joists 6 are provided with angled plates (not shown) to support insulation sheets 15 (see FIG. 2), which are thereby spaced from the foundation 2. Each joist 6 is provided with a plurality of vertical holes 7 drilled through it and arranged at a pre-determined distance from each other. The drill holes 7 have a threading with small pitch. Level-adjusting spacer screws 8 having external threading with a pitch equal to that of the threading of the drill holes 7 are screwed into the drill holes 7. The screws 8 have hexagonal recesses, accessible from the upper side for co-operation with a turning device, and narrow central through-holes for anchoring the screws 8 to the foundation 2 with nails or screws once the position of the joist 6 has been determined. With the aid of the screws 8, the joists 6 are set at a certain elevation above the foundation 2 so that a free passage 9 is created between the underside of the joist 6 and the foundation 2 and so that the top sides of the joists 6 are located in one and the same plane, the screws 8 maintaining sufficient screwing engagement with the joists 6 to fix and support the joists 6 at the level set and to support the remainder of the floor construction.

The first joist 6*a* is located a pre-determined distance from the outer wall 1 so that a channel 10 is created on the inside of the ground sill 3, which channel extends continuously along the ground sill 3.

Said passage 9 below the joists 6 as well as the channel 10 along the ground sill 3 form part of said space 5, which is thus free for air flows and continuous in all directions along the foundation 2.

The floor construction is ventilated by a ventilation system, comprising a suction source (not shown), which can be a wall-mounted fan and connected to said space 5 underneath the floor construction via a pipe system, comprising a pipe 11, to extract air from the space 5, as indicated by arrows in FIG. 1. The supply air to the space 5 underneath the floor construction is provided by the room 12 and thus consists of warm indoor air The ventilation system comprises a plurality of air-inlet devices 13, arranged at pre-determined locations on the floor construction adjacent to a wall 1, whereby the supply air flows into and through the air-inlet devices 13 and further down into said channel 10 of the space 5 via an opening 14 (see FIG. 1) in the floor construction. The ventilation system can favourably be dimensioned in accordance with the technique described in patent SE-509 097.

To distribute the supply air in an efficient way as it flows down into the space 5, an arrangement is favourably used that comprises an elongate, rectangular, plate-shaped body 16, manufactured in one piece from a suitable plastic material, for instance polypropylene. The plate-shaped body 16 comprises a waist part 17 with a pre-determined width, a foot part 18 and a top part 19. The foot and top parts 18, 19 are parallel to each other and sufficiently wide to be able to accommodate appropriate attachment elements 20, 21 for attachment of the body 16. The foot part 18 is flexibly connected to the waist part 17, via a continuous, tight joint 22, so that the requisite angle for each individual fitting can be set between them, see FIGS. 7, 8 and 9. The top part 19 is in like manner flexibly connected to the waist part 17, via a continuous, tight joint 23 so that the requisite angle for each individual fitting can be set between them, see FIGS. 6, 7 and 8. The two joints 22, 23, which are parallel to each other, thus have the shape of tight hinge joints so that the top and foot parts 19, 18 can be pivoted in the desired directions relative to the waist part 17. The joints 22, 23 can be created by two grooves 24, 25 being made on at least one side of a plate slab, each joint 22, 23 consisting of the thinner, remaining, non-perforated material, see FIG. 3. To be relatively self-supporting, i.e. not collapsing due to its own weight, the plate-shaped body 16 should have a sheet thickness of at least 1.5 mm, preferably at least 2.0 mm. Having regard to the cost of materials, handling aspects and workability, the sheet thickness should not be exaggeratedly great. The plate-shaped body 16 is yielding to such an extent that it bends to negotiate uneven parts in the foundation 2 so that the foot part 18, in particular, adapts to such uneven parts whilst being mounted by means of the attachment elements 21.

The air-distribution device further comprises a plurality of spacers 26, equidistantly arranged along the foot part 18 and having a pre-determined length so that the foot part 18 is kept at a pre-determined distance above the foundation 2, whilst defining a narrow air gap 27, which air gap 27 thus has a correspondingly pre-determined height. In the embodiment shown, the spacers 26 consist of loose plastic bushings, placed between the foot part 18 and the foundation 2 and fixed by means of suitable attachment elements 21, which extend through holes 28 in the foot part 18 and the plastic bushings 26 and are anchored in the foundation 2. The spacers 26 can be 2–6 mm long depending on the desired height of the air gap 27. The preferred height of the air gap is about 3 mm.

The plate-shaped body 16 is anchored to the inner, vertical side of the joist 6*a* located nearest the ground sill 3 by using suitable attachment elements 20, for instance staples, that are pressed through the top part 19 into the joist 6*a* in such a way that the waist part 17 extends from the underside of the joist 6*a* and extends at an angle down towards the foundation 2. Thereafter, the plate-shaped body 16 is anchored to the foundation 2 by way of sleeved screws 21 that are inserted through the pre-drilled holes 28 in the foot part 18 and through the plastic bushings 26 and screwed into the foundation 2, the foot part 18 adjusting itself to accommodate any unevenness in the foundation 2, thanks to its yielding property, so that the air gap 27 obtains a virtually uniform height along the foot part. 18.

Figure 7:
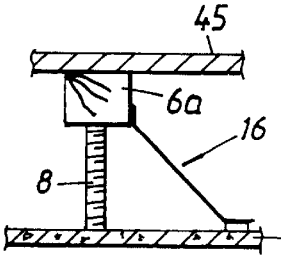
FIGS. 7, 8 and 9 are end views of floor constructions at different levels of elevation above the subfloor and illustrate the use of the air-distribution device in accordance with FIG. 3 with one and the same dimensional design.
Figure 8:
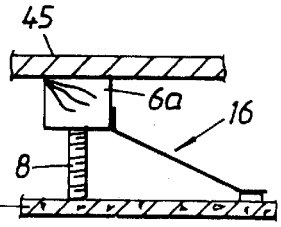
Figure 9:
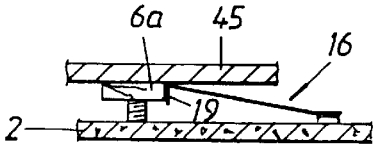

As is evident from FIGS. 7, 8 and 9, the air-distribution device in one and the same design is useful for floor constructions situated at different levels of elevation above the subfloor 2, the level of elevation being determined by the length of the level-adjusting spacer screws 8. In so-called low-profile floors in accordance with FIG. 9, the top part 19 can be folded downwards so as to obtain a more obtuse angle between the waist part 17 and the foot part 18, which is advantageous. Generally, this obtuse angle is between about 110° and about 175°.

Figure 6:
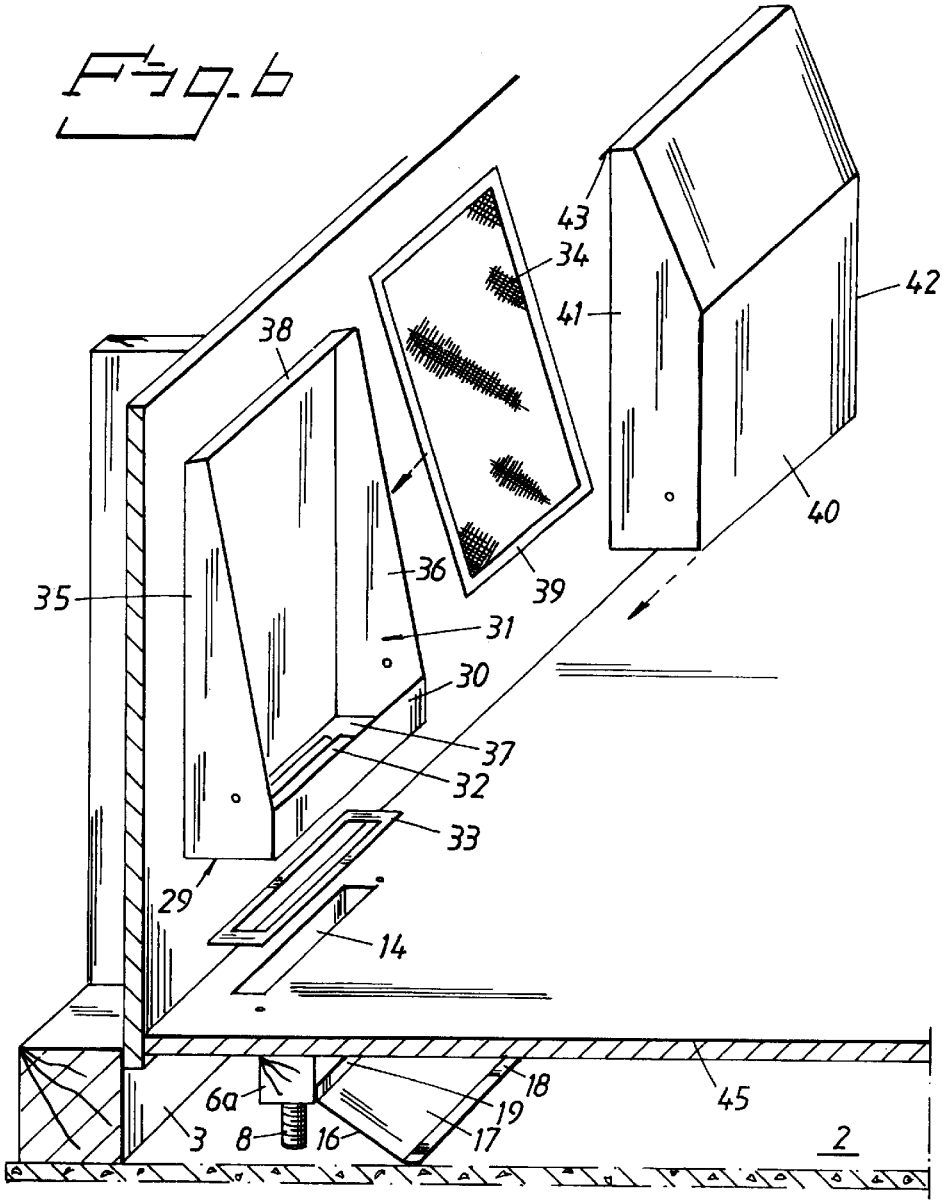
FIG. 6 is a perspective view, substantially similar to the one in FIG. 5, the air-inlet device being shown in an exploded view.

As is evident from FIG. 6, the air-inlet box 13 has a box-shaped filter-holder 29, which is attached to the wall 1 and which is provided with a lower front wall 30 of low height and a front opening 31 extending upwards therefrom. The filter-holder 29 has in its bottom an elongate opening 32 that is aligned with the corresponding elongate opening 14 of equal size in the floor 45. A sealing gasket 33 is placed between the filter-holder 29 and the floor to prevent penetration of water in the event of leakage in the room. Thanks to the front wall 30, which can have a height of about 5 cm, large quantities of water can accumulate on the floor before water penetrates down to the subfloor 2. A filter 34 is arranged in the filter-holder 29 to be easily detached therefrom and extends between the side walls 35, 36 and between the bottom 37 and top 38 to be sealed all around with its side sections situated outside a rigid frame 39, the frame 39 resting on an upturned edge of the opening 32 and being located closest to the front wall 30. The filter-holder is covered by a hood 40 with a width slightly greater than the filter-holder 29 so that vertical air gaps are created between the vertical side walls 41, 42 of the hood 40 and the vertical side walls 35, 36 of the filter-holder 29. Each air gap has a width of about 0.5–1.5 cm. The hood 40 has a downwardly directed top flange 43 that hooks on behind the top wall 38 of the filter-holder 29, the hood 40 then being secured by screws 44 to the filter-holder 29. The inner free edges of the vertical side walls 41, 42 of the hood 40 are located a suitable distance, for instance 0.5–1.5 cm, from the wall to allow the supply flow of air to said air gap inside the hood 40 and then to the openings 32, 14 in the bottom and in the floor via the filter 34, see FIG. 5.

The air-distribution device distributes the supply air along its entire length. The distribution of the ventilating air and a pressure drop occurs underneath the flooring layer 45 so that only the space 5 between the subfloor 2 and the flooring layer 45 downstream of the air-distribution device is subject to lowered pressure. With an air pressure close to that in the room 12 above, the part space between the ground sill 3 and the air-distribution device serves as an air channel 10 distributing the air up to the constriction in the form of the air gap 27 created between the air-distribution device and the subfloor 2. The significant pressure drop occurs in said air gap 27. The subfloor 2 from the air-distribution device to the pipe system for exhaust air is thus ventilated in a uniform way, the part space between the ground sill 3 and the air-distribution device being ventilated in connection with its service as a channel. The ground sill 3 and all relevant building components must be sealed to a high degree so that no undesirable air leakage arises, but the strain on the sealing capacity of the ground sill 3 when using the air-distribution device is not as great as when the significant pressure drop occurs above the flooring layer 45. The ground sill 3 is a building component that is difficult to seal, as it adjoins the outdoor air with its changes in temperature and humidity. The air-distribution device is easily mounted and its function is clear and simple, which increases understanding of the system.

The described air-inlet device 13 replaces about 6 metres of air-pervious skirting-board and has the advantage of providing control over the descent of the air through the floor in one location. The air-distribution device 13 is mounted after carpet laying. It is also mounted afterwards in the case of turned-up carpets, as it is rounded off in its inner lower corner to accommodate the turn-up fillet. The air-inlet device 13 does not interfere with the finishing of the flooring layer 45 against the wall. It is easily mounted and it is clear and simple in its function. It can tolerate splashes of water and is made to withstand temporary accumulation of water on a wet floor to a level of about 5 cm. It has a washable filter that can be removed with a simple manual grip, rinsed through and re-mounted, while all skirting-boards and other building components are left in place. With the air-distribution device, thanks to its large through-flow area, it is possible to inspect and clean the air channel 10 created between the ground sill 3 and the air-distribution device.

In accordance with the invention, a special screening arrangement that will be further described in the following is suggested for partitioning the ventilated space into sections or against its surroundings in the building.

The screening arrangement comprises an elongate, rectangular, plate-shaped body 116, manufactured in one piece from a suitable plastic material, for instance polypropylene. The plate-shaped body 116, which is impermeable to gas and liquid, comprises a waist part 117 with a predetermined width, a foot part 118 and a top part 119. The foot and top parts 118, 119 are parallel to each other and sufficiently wide to be able to accommodate appropriate attachment elements 120, 121 for attachment of the body 116. The foot part 118 is flexibly connected to the waist part 117, via a continuous, tight joint 122, so that the requisite angle for each individual fitting can be set between them. The top part 119 is in like manner flexibly connected to the waist part 117, via a continuous, tight joint 123 so that the requisite angle for each individual fitting can be set between them. The two joints 122, 123, which are parallel to each other, thus have the shape of tight hinge joints so that the top and foot parts 119, 118 can be pivoted in the desired directions relative to the waist part 117. The joints 122, 123 can be created by two grooves 124, 125 being made on at least one side of a plate slab, each joint 122, 123 consisting of the thinner, remaining, non-perforated material, see FIG. 4. To be relatively self-supporting, i.e. not collapsing due to its own weight, the plate-shaped body 116 should have a sheet thickness of at least 1.5 mm, preferably at least 2.0 mm. Having regard to the cost of materials, handling aspects and workability, the sheet thickness should not be exaggeratedly great. The plate-shaped body 116 is yielding to such an extent that it bends to negotiate uneven parts in the foundation 2 so that the foot part 118, in particular, adapts to such uneven parts whilst being mounted by means of the attachment elements 121.

On one of their sides, the foot and top parts 118, 119 are provided with a sealing layer or stripe 46 of a suitable sealing material, which sealing layers 46 are intended to seal against the horizontal foundation 2 and a vertical construction surface 47, for instance one of the vertical surfaces of a joist 6. The foot and top parts are provided with a plurality of evenly distributed holes 128 for receiving the attachment elements 120, 121, which, in the case of the top part 119, suitably consist of screws that are screwed into the joist 6 and, in the case of the foot part 118, suitably consist of expansion devices that are made up of an expansion sleeve and an expansion nail or screw to effectively anchor the screening arrangement to the concrete floor.

Alternatively, the top part 119 lacks such holes 128, the anchoring being performed by means of staples that are pressed into the joist 6 through the top part 119.

The waist part 117 is sufficiently wide so that is inclined at a suitable angle, such as 20°–80°, preferably 30°–60°, to the concrete foundation 2, based on a certain level for attaching the top part 119.

What is claimed is:

1. An arrangement for screening off a ventilated space (5) in a floor construction in a building, which space (5) forms part of a ventilation system, which floor construction is arranged on a subfloor (2) and comprises a plurality of joists (6) arranged at a pre-determined distance from each other and supported by a plurality of level-adjusting spacer screws (8) resting on the subfloor (2) to create a free passage (9) between the joist (6) and the subfloor (2) as well as said space (5), which includes said passages (9), between the subfloor (2) and the floor construction, characterized in that it comprises an elongate plate-shaped body (116) that is impermeable to air and includes a flat waist part (117), a foot part (118) and a top part (119), which foot and top parts (118, 119) extend along the long sides of the waist part (117) and are flexibly connected to the waist part (117) by means of joints (122, 123) that are parallel to each other, which plate body (116) is arranged to be anchored with its top part (119) to a vertical side of one of said joists (6) by means of attachment elements (120) and arranged to be anchored with its foot part (118) to the subfloor (2) by means of attachment elements (121), the waist part (117) being arranged to form a right or acute angle with the subfloor (2) so as to form an airtight screen between two sections of the ventilated space (5) or between the ventilated space (5) and a non-ventilated space in the floor construction.

2. An arrangement as claimed in claim 1, characterized in that one and the same dimension of the plate body (116) is useful for floor constructions which are positioned at different levels of elevation relative to the subfloor (2), the width of the waist part (117) being equal to or greater than the distance between the subfloor (2) and the underside of the joist (6) to form a right or acute angle with the subfloor (2).

3. An arrangement as claimed in claim 1, characterized in that the plate body (116) is manufactured from a plastic material, preferably polypropylene, and has a wall thickness of at least about 1.5 mm, preferably at least 2.0 mm, and in that the width of the waist part (117) is about 6–15 cm and the width of the foot and top parts (118, 119) is about 1.5–2.0 cm in each case.

4. An arrangement as claimed in claim 1, characterized in that the foot part (118) and the top part (119) are provided with a sealing layer (46) on their sides facing the joist (6) a and the subfloor (2).

5. An arrangement as claimed in claim 1, said ventilation system also comprises a plurality of air-inlet devices (13) arranged at a pre-determined distance from each other by at least one wall (1) and each being in open communication with an opening (14) in the floor construction to said space (5), characterized in that it forms part of the floor construction in combination with an air-distribution device, comprising an elongate plate-shaped body (16), rigidly mounted to the joist **(6*a*) located nearest said openings (14) for the air-inlet devices (13), which plate body (16) includes a flat waist part (17), a foot part (18), a top part (19), which foot and top parts (18, 19) extend along the long sides of the waist part (17) and are flexibly connected to the waist part (17) by means of joints (22, 23) that are parallel to each other, and a plurality of spacers (26) arranged adjoining the foot part (18) to create an air gap (27) between the foot part (18) and the subfloor (2) when the plate body (16) is anchored to the subfloor (2), which plate body (16) is arranged to be anchored to said joist (6***a*) by means of its top part (19) with the waist part (17) sloping down towards the subfloor (2) at an acute angle and forming an obtuse angle with the foot part (18) and an obtuse or an acute angle with the top part (19), the air gap (27) being arranged to provide a pressure drop in the ventilation air passing through the same.

6. An arrangement as claimed in claim 5, characterized in that the plate body (16), the joist (6*a*), the adjoining wall (1) and the subfloor (2) or a special arrangement for screening off the ground sill are arranged to define between them an air channel (10) that communicates with said air gap (27) and has a pre-determined cross-sectional area, allowing the supply air from each air-inlet device (13) to flow along the entire air channel (10) and to be evenly distributed along the same, and in that the spacers (26) are of the same height to form said air gap (27) with a virtually uniform height.

7. An arrangement as claimed in claim 5, characterized in that one and the same dimension of the plate body (16) is useful for floor constructions which are positioned at different levels of elevation relative to the subfloor (2), the width of the waist part (17) being equal to or greater than the distance between the subfloor (2) and the underside of the joist (6*a*) to form an acute angle that is smaller than 70°, preferably smaller than 50°, with the subfloor.

8. An arrangement as claimed in claim 5, characterized in that the spacers (26) are integral with the plate body (16) on one of its sides or consist of separate pieces or constitute a fixed or loose part of the attachment elements (21).

9. An arrangement as claimed in claim 5, characterized in that the air gap (27) has a height of about 2–6 mm, preferably about 3 mm.

10. An arrangement as claimed in claim 5, characterized in that the plate body (16) is manufactured from a plastic material, preferably polypropylene, and has a wall thickness of at least about 1.5 mm, preferably about 2.0 mm, and in that the width of the waist part (17) is about 8–15 cm and the width of the foot and top parts (18, 19) is about 1.5–2.0 cm in each case.

11. An arrangement as claimed in claim 5, characterized in that the obtuse angle between the waist part (17) and the foot part (18) in the mounted state of the arrangement, is between about 110° and about 175°.

12. A floor construction arranged on a foundation (2) in a building, the floor construction comprising a plurality of joists (6) arranged at pre-determined distances from each other and supported by a plurality of level-adjusting spacer screws (8) resting on the subfloor (2) to form a free passage (9) between the joist (6) and the subfloor (2) as well as a free, continuous space (5), including said passages (9), between the subfloor (2) and the floor construction, which space (5) forms part of a ventilation system, which further comprises a plurality of air-inlet devices (13) arranged at a predetermined distance from each other by at least one wall (1) and each being in open communication with an opening (14) in the floor construction to said space (5), characterized in that it comprises a screening arrangement in accordance with claim 1.

13. A floor construction as claimed in claim 12, characterized in that it further comprises an air-distribution device.

* * * * *

UNITED STATES PATENT AND TRADEMARK OFFICE

CERTIFICATE OF CORRECTION

PATENT NO. : 6,554,699 B1
DATED : April 29, 2003
INVENTOR(S) : Johansson

It is certified that error appears in the above-identified patent and that said Letters Patent is hereby corrected as shown below:

Title page,
Item [57], ABSTRACT,
Lines 15-16, delete "(12) anchored" and insert -- (120) and to be anchored --.

Signed and Sealed this

Second Day of September, 2003

JAMES E. ROGAN
*Director of the United States Patent and Trademark Office*